United States Patent [19]

Cumming

[11] 4,074,588

[45] Feb. 21, 1978

[54] CONTROL UNIT HAVING AN ADJUSTABLE DIFFERENTIAL AND METHOD OF MAKING THE SAME

[75] Inventor: Edward P. Cumming, Milford, Conn.

[73] Assignee: Robertshaw Controls Company, Richmond, Va.

[21] Appl. No.: 659,168

[22] Filed: Feb. 18, 1976

Related U.S. Application Data

[62] Division of Ser. No. 456,813, April 1, 1974, Pat. No. 3,952,611.

[51] Int. Cl.[2] ..... G05G 1/04

[52] U.S. Cl. ..... 74/522; 73/368.7; 236/DIG. 1

[58] Field of Search ..... 74/522; 73/368.7; 236/DIG. 1

[56] References Cited

U.S. PATENT DOCUMENTS

| | | | |
|---|---|---|---|
| 1,751,172 | 3/1930 | Reinhardt | 236/DIG. 1 |
| 1,868,555 | 7/1932 | Wiley | 236/DIG. 1 |
| 2,225,956 | 12/1940 | Haines | 236/DIG. 1 |
| 2,298,827 | 10/1942 | Joesting | 236/DIG. 1 |
| 2,620,414 | 12/1952 | Thorsheim | 73/368.7 |

*Primary Examiner*—Clarence R. Gordon
*Attorney, Agent, or Firm*—Candor, Candor & Tassone

[57] ABSTRACT

A control unit having a condition selector, an actuator and a condition responsive device for actuating the actuator when the condition responsive device senses a condition selected by said selector. A lever is carried by the unit and has opposed ends respectively operatively associated with the actuator and the device. The selector has an adjustable part thereof engageable with the lever intermediate the ends thereof for providing a pivot point for the lever. The adjustable part of the selector is adapted to adjust the differential in the operation of the actuator by the device, the adjustable part providing for a positive differential or for a negative differential.

15 Claims, 18 Drawing Figures

CONTROL UNIT HAVING AN ADJUSTABLE DIFFERENTIAL AND METHOD OF MAKING THE SAME

This application is a divisional application of its copending parent patent application, Ser. No. 456,813, filed Apr. 1, 1974, now U.S. Pat. No. 3,952,611.

This invention relates to an improved control unit having an adjustable differential and to a method for making such a control unit or the like.

It is well known that control units have been provided wherein an actuator of the unit will be actuated by a condition responsive device when the condition responsive device senses a certain condition that has been selected by a selector of the control unit. For example, such a control unit can comprise a thermostat or the like.

It is a feature of this invention to provide improved means for adjusting the differential in the operation of the actuator for such a unit or the like.

In particular, one embodiment of this invention provides a control unit having a condition selector means, an actuator and a condition responsive device for actuating the actuator when the condition resonsive device senses a condition selected by the selector means. A lever is carried by the unit and has opposed ends respectively operatively associated with the actuator and the device. The selector means has an adjustable part thereof engageable with the lever intermediate the ends thereof for providing a pivot point for the lever, the adjustable part being adapted to adjust the differential in the operation of the actuator by the device. Such adjustable part can be utilized for adjusting the positive differential of the unit or for adjusting the negative differential thereof.

Accordingly, it is an object of this invention to provide an improved control unit having one or more of the novel features set forth above or hereinafter shown or described.

Another object of this invention is to provide an improved method of making such a control unit or the like.

Other objects, uses and advantages of this invention are apparent from a reading of this description, which proceeds with reference to the accompanying drawings forming a part thereof and wherein.

Figure 1:
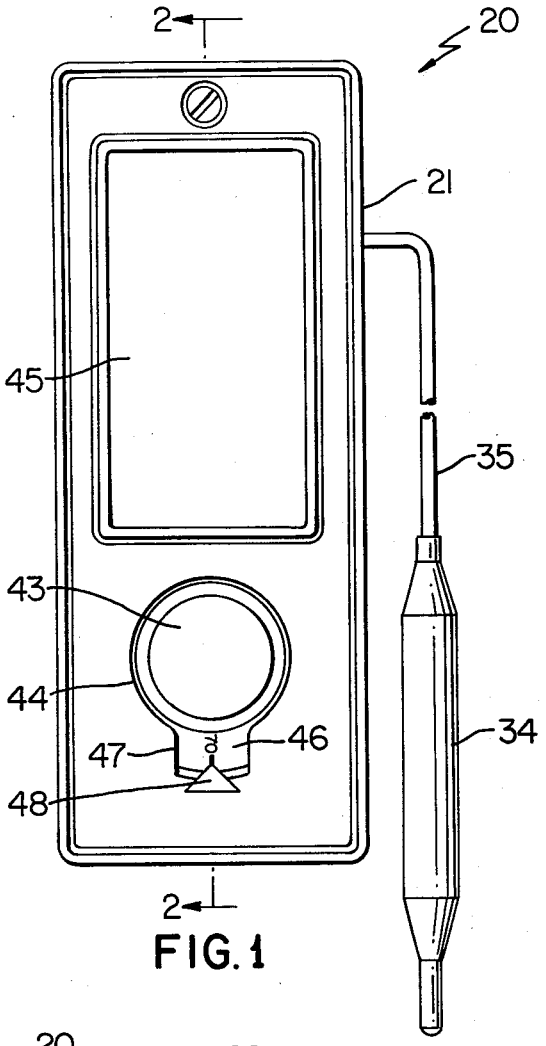
FIG. 1 is a front view of the improved control unit of this invention.

While the various features of this invention are hereinafter described and illustrated as being particularly adapted to provide a control unit that senses temperature, it is to be understood that the various features of this invention can be utilized singly or in any combination thereof to provide control units sensing other conditions as desired.

Therefore, this invention is not to be limited to only the embodiments illustrated in the drawings, because the drawings are merely utilized to illustrate one of the wide variety of uses of this invention.

Figure 2:
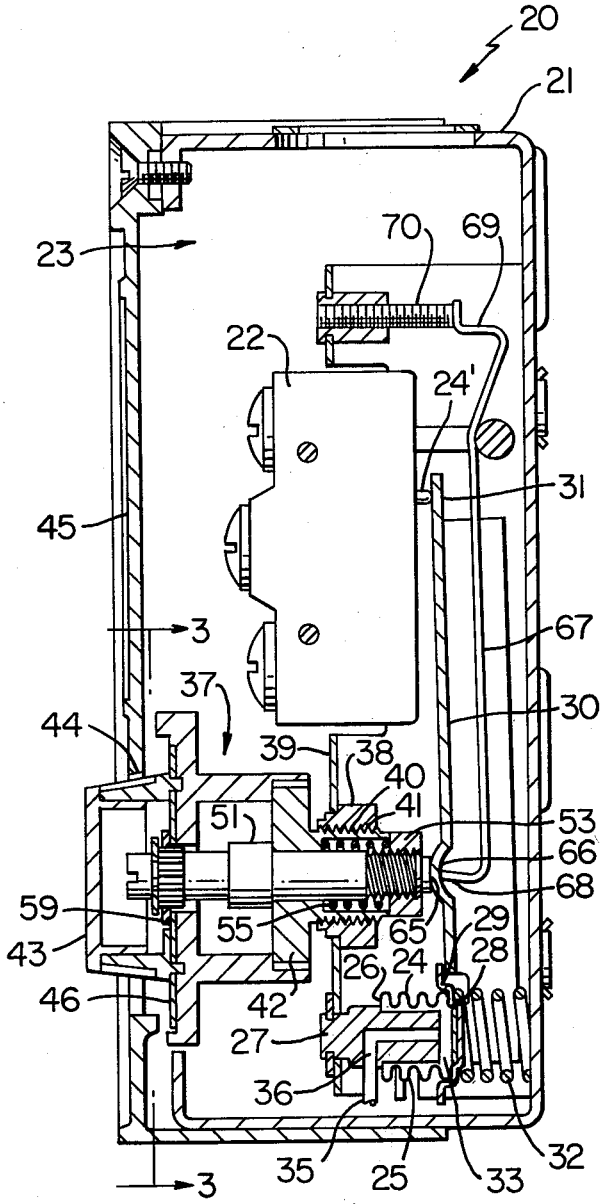
FIG. 2 is an enlarged cross-sectional view taken on line 2—2 of FIG. 1.
Figure 3:
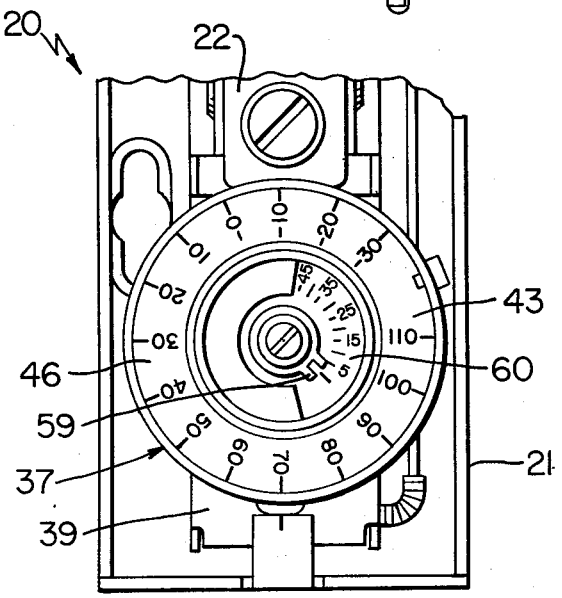
FIG. 3 is a fragmentary, cross-sectional view taken substantially on the line 3—3 of FIG. 2.
Figure 6:
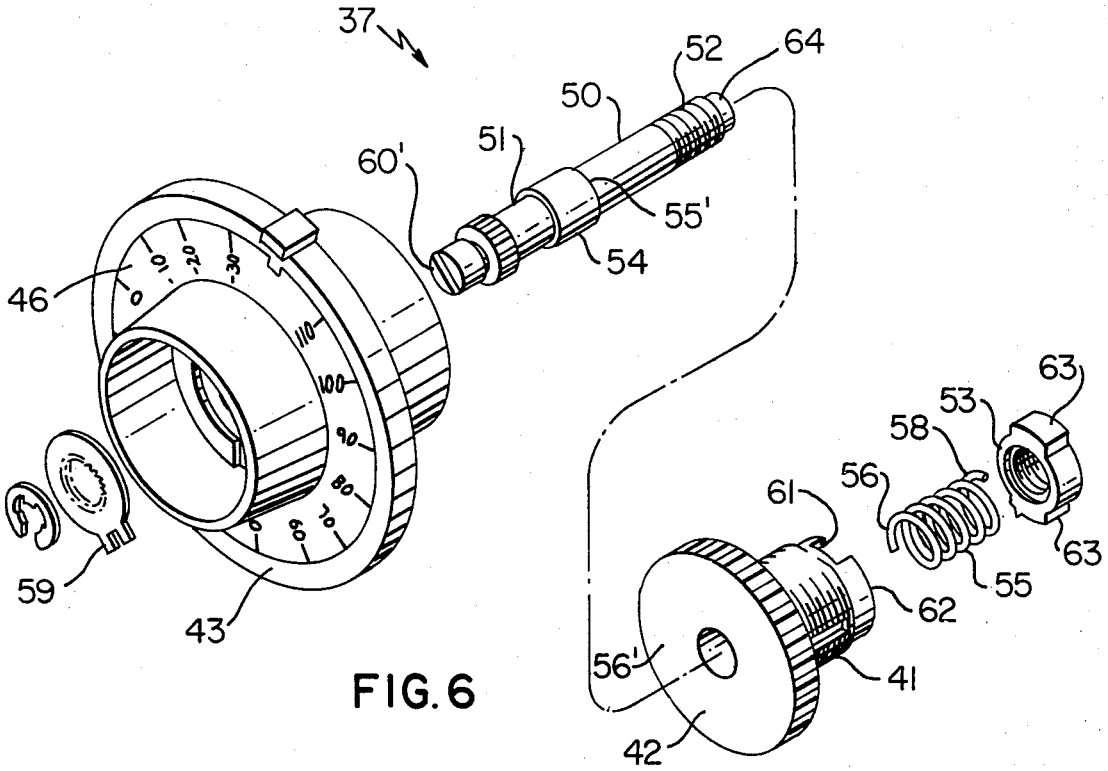
FIG. 6 is an exploded perspective view of the various parts of the selector means of FIG. 4.

Referring now to FIGS. 1, 2 and 3, an improved control unit of this invention is generally indicated by the reference numeral 20 and comprises a housing means 21 carrying an actuator 22 in an internal chamber 23 thereof, the actuator 22 comprising an electrical switch construction which has the electrical switch thereof (not shown) opened and closed by an actuating plunger 24' that projects out of the switch construction 22 in a conventional manner.

A condition responsive device 24 is also carried by the housing means 21 in the chamber 23 thereof and comprises a bellows construction 25 having an open end 26 thereof sealed closed by a frame member 27 and a free closed end 28 thereof adapted to bear on a cup-shaped end 29 of a lever 30 disposed in the chamber 23 and having the other opposed end 31 thereof engageable with the plunger 24' of the actuator 22. A compression spring 32 is disposed between the end 29 of the lever 30 and the housing 21 so as to tend to maintain the end 29 of the lever 30 in contact with the movable part or end 28 of the bellows construction 25.

A chamber 33 formed inside the bellows construction 25 is adapted to be fluidly interconnected to a temperature sensing bulb 34 by a capillary tube 35 interconnected to the fitting 27 and disposed in fluid communication with an internal passage 36 thereof which leads to the chamber 33 of the bellows construction 25. The bulb 34 can be filled with a liquid or gas that is temperature responsive whereby as the temperature thereof increases, the fluid increases in volume and thus expands in the chamber 33 of the bellows construction 25 to tend to move the movable wall 28 thereof to the right in FIG. 2 and upon a decrease in temperature of the liquid or gas in the bulb 34, the volume of the same in the chamber 33 of the bellows construction 25 decreases and thereby permits the movable wall 28 to move to the left under the force of the compression spring 32 as will be apparent hereinafter. In this manner, the end 29 of the lever follows the movement of the end 28 of the bellows construction 25 for operating the actuator 22 as will be apparent hereinafter.

A selector means of this invention is generally indicated by the reference numeral 37 and comprises a nut-like member 38 fixed to an internal frame means 39 of the housing means 21 that carries the electrical switch 22 and condition responsive device 24 as illustrated in FIG. 2, the nut-like member 38 having a threaded bore 40 passing therethrough and threadedly receiving a threaded part 41 of a main adjusting member 42 that carries a knob construction 43 whereby rotation of the knob construction 43 relative to the housing means 21 will likewise cause rotation of the main adjusting member 42 to cause the same to thread inwardly or outwardly in the threaded bore 40 of the nut 38 for a purpose hereinafter described. The knob construction 43 is adapted to project out through an opening 44 formed in a cover plate or surface 45 of the housing means 21 as illustrated and has a temperature scale means 46 visible through a lower part 47 of the opening 44 as illustrated in FIG. 1 so that a selected temperature on the scale 46 can be positioned relative to a stationary indicator pointer 48 to indicate the temperature setting of the control device 20.

Thus, as illustrated in FIG. 1 and 3, the knob construction 43 has been set for 70° F so that when the temperature sensing bulb 34 senses a temperature of approximately 70° F, the same will cause the lever 30 in a manner hereinafter described, to operate the plunger 24' of the actuator 22 to cause the actuator 22 to either open or close the circuit thereof, as the case may be, as will be apparent hereinafter.

Figure 4:
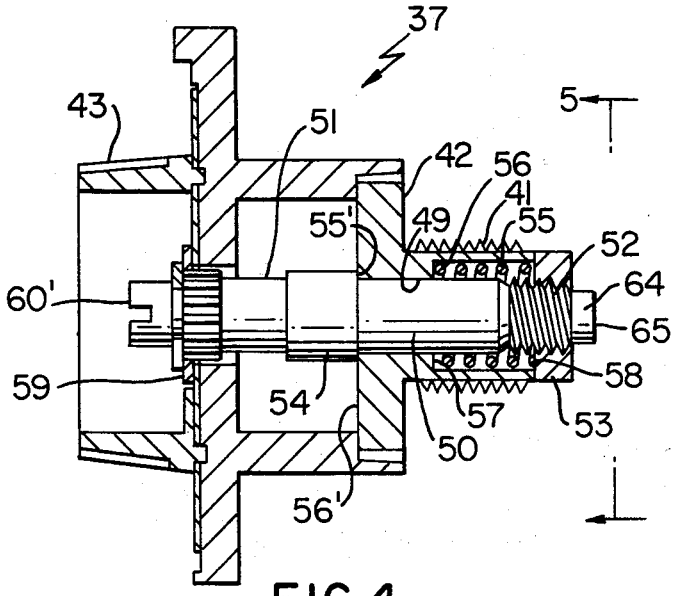
FIG. 4 is an enlarged cross-sectional view of the selector means of the control unit of FIG. 2.

The main adjusting member 42 of the selector means 37, as best illustrated in FIGS. 2 and 4, has a stepped bore 49 passing therethrough and loosely receiving a reduced cylindrical part 50 of an auxiliary member 51 of this invention which has a threaded part 52 disposed on the right-hand end thereof and threadedly carrying a nut-like member 53. The auxiliary adjusting member 51 has an enlarged central part 54 that defines a shoulder 55' adapted to engage against an end wall 56' of the main adjusting member 42 under the force of a compression spring 55 disposed in the stepped bore 49 of the main adjusting member 42 and having one end 56 thereof bearing against a shoulder 57 of the main adjusting member 42 and against the nut 53 at the other end 58 thereof for a purpose hereinafter described. The left-hand end of the auxiliary adjusting member 51 carries a pointer means or indicator 59 fixed thereon adapted to be positioned relative to a differential scale 60 carried on the knob construction 43 as illustrated in FIG. 3 to indicate the rotational position of the auxiliary adjusting member 51 when the same is rotated relative to the main adjusting member 42 by a suitable tool being inserted in a bifurcated end 60' of the adjusting member 51 to rotate the same relative to the main adjusting member 42 for a purpose hereinafter described.

Figure 5:
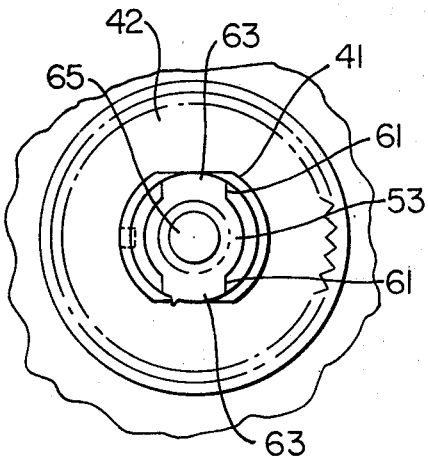
FIG. 5 is a fragmentary end view taken in the direction of the arrows 5—5 of FIG. 4.

The externally threaded part 41 of the main adjusting member 42 has a pair of slots 61 formed in the left-hand end 62 thereof that are adapted to respectively receive outwardly directed ears 63 on the nut-like member 53 as illustrated in FIG. 5 whereby the nut-like member 53 is adapted to be axially moved in the slot 61 relative to the main adjusting member 42 in a manner hereinafter described while being held from rotational movement relative to the main adjusting member 42.

The threaded end 52 of the auxiliary adjusting member 51 has an end part 64 provided with a flat end surface 65 adapted to engage against a bowed part 66 of the lever 30 with the bowed part 66 of the lever 30 being formed intermediate the opposed ends 29 and 31 thereof to provide a pivot point for the lever 30 as will be apparent hereinafter. In order to maintain the bowed part 66 of the lever 30 into contact with the end surface 65 of the auxiliary adjusting member 51, a leaf spring 67 has a free end 68 thereof bearing against the lever 30 adjacent the bowed part 66 thereof and an opposite end 69 bearing against an adjusting member 70 of the frame 39 so that the natural resiliency of the leaf spring 67 by bearing against part of the frame 39 is to move the end 68 thereof to the left in FIG. 2 and thereby maintain the bowed part 66 of the lever 30 in contact with the end surface 65 of the auxiliary adjusting member 51.

Therefore, it can be seen that the control unit 20 and selector means 37 thereof can be formed in a relatively simple manner to operate in a manner now to be described.

Figure 9:
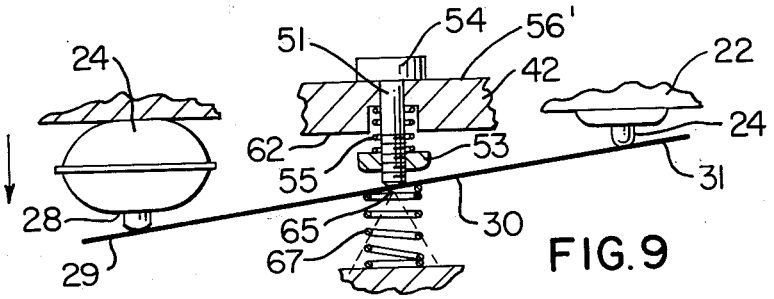

Assuming that it is desired to utilize the control unit 20 of this invention for controlling the operation of a heating unit so that the heating unit will be operating as long as the electrical switch 22 of the unit 20 has the electrical switch thereof in a closed condition and that the electrically operated heating unit will terminate its operation when the plunger 24' of electrical switch 22 is moved inwardly as illustrated in FIG. 9 to terminate the electrical flow through the switch 22 and, thus, to the heating unit. Also, assume that the heating unit will not be again turned on until the plunger 24' of the actuator 22 is moved outwardly to the position illustrated in FIG. 11 to again close the switch in the electrical switch construction 22 in a manner hereinafter described.

Thus, the operator turns the control knob 43 of the selector means 37 to the desired temperature that the unit 20 is to tend to maintain with the understanding that the unit 20 will turn off the heating unit when the temperature sensing bulb 34 senses an output temperature effect thereof substantially at the temperature setting of the control knob 43, which in the example illustrated in the drawings is 70° F. Thereafter, the operator adjusts the auxiliary adjusting member 51 through rotation thereof to provide a desired differential in the temperature that the sensing bulb 34 is to detect before the unit 20 will again turn on the heating unit after it has turned off the heating unit.

For example, the member 51 can be adjusted so that there will be no differential all the way up to a 45° F differential as illustrated in FIG. 3 so that should a ten degree differential be chosen, the unit 20 will not turn on the heating unit once the same has been turned off by the unit 20 until the output temperature effect sensed by the bulb 34 reaches 60° F or 10° below the setting of the main knob 43 whereby the member 51 is being utilized as an adjustable negative differential for the control unit 20.

Figure 7:
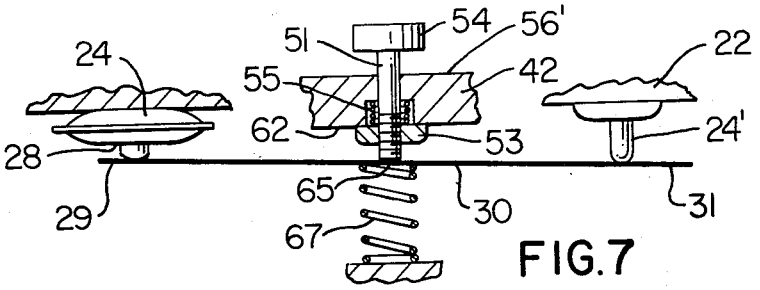
FIG. 7 is a schematic view of the control unit of FIG. 2 and illustrates the same in one of the operating conditions thereof.

Therefore, when the operator turns the selector knob 43 to select the desired temperature setting, such as the 70° F illustrated in the drawings, such rotation of the selector knob 43 rotates the main adjusting member 42 in its threaded relation with the threaded nut 38 to position the end 62 thereof to a particular position relative to the frame 39 and, thus, the end 65 of the adjusting member 51 relative to the frame 39. Thereafter, the adjusting of the adjusting member 51 to provide the desired differential, such as to 10° F as previously described, causes the nut 53 to be adjusted on the fitted end 52 of the adjusting member 51 to provide a lost motion between the member 51 and the main adjusting member 42 as illustrated in FIG. 7. Thus, as long as the temperature being sensed by the bulb 34 is below 70° F, the condition responsive device 24 has not expanded sufficiently to move its end 28 downwardly in FIG. 7 and the nut 53 is held against the end 62 of the main adjusting member 42 by the force of the spring 67, which in FIGS. 7 through 11 is systematically illustrated as a compression spring rather than the leaf spring illustrated in FIG. 2. Such movement of the nut 53 against the end 62 of the main adjusting member 42, raises the enlarged central part 54 of the auxiliary adjusting member 51 relative to the end surface 56' of the main adjusting member 42 as illustrated.

Figure 8:
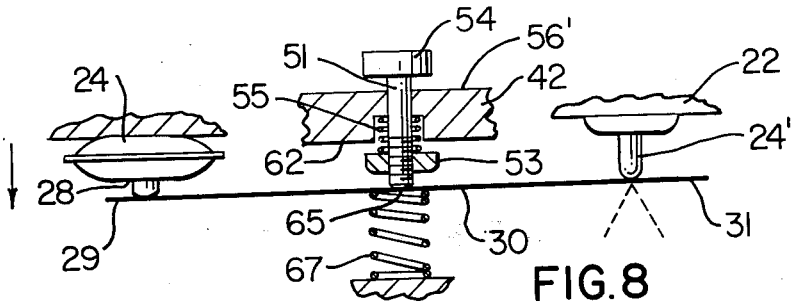
FIGS. 8–11 are respectively views similar to FIG. 7 and illustrate the control unit of FIG. 2 during various phases of the operation thereof.

As the output temperature effect of the heating unit increases through the electrical switch 22 being in the closed position thereof and thereby operating the heating unit, the fluid in the condition responsive device 24 expands to move the movable wall 28 thereof downwardly as illustrated in FIG. 8. However, such downward movement of the wall 28 carries the end 29 of the lever 30 therewith but since the auxiliary adjusting member 51 has a lost motion to take up before the end 54 thereof hits against the surface 56' of the main adjusting member 42, the lever 30 actually pivots on the plunger 24' of the switch construction 22 so that the plunger 24' remains in its full out condition until the enlarged portion 54 of the auxiliary adjusting member 51 abuts against the surface 56' of the main adjusting member 42 as illustrated in FIG. 9 which in the selected example is when the temperature sensing bulb 34 senses 70° F. At this time, the lever 30 now pivots on the end 65 of the adjusting member 51 to toggle the plunger 24' of the switch 22 and move the same inwardly to thereby open the electrical circuit through the electrical switch construction 22 to terminate the operation of the heating unit.

Figure 10:
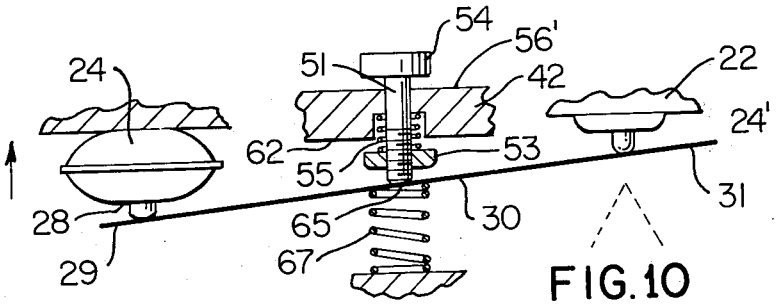
Figure 11:
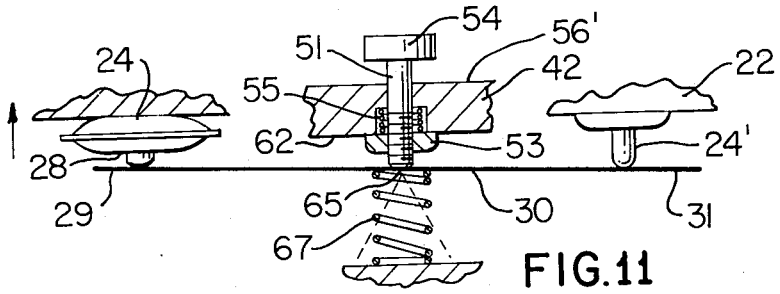

Thus, with the heating unit now no longer operating, the output temperature effect thereof begins to drop so that the condition responsive means 24 begins to collapse as illustrated in FIG. 10. However, since the nut 53 is not against the surface 62 of the main adjusting member 42, the adjusting member 51 is adapted to move upwardly under the force of the compression spring 67 as illustrated in FIG. 10 so that the lever 30 is still pivoting on the plunger 24' of the switch 22. Thus, the plunger 24' of the switch 22 remains inwardly in its switch open condition until the nut 53 engages against the surface 62 of the main adjusting member 42 as illustrated in FIG. 11 whereby the lever 30 can now pivot on the end 65 of the adjusting member 51 and permit the plunger 24' of the electrical switch construction 22 to move outwardly and thereby again close the electrical switch in the switch construction 22 to operate the heating means. However, in this example, such toggling of the plunger 24' of the electrical switch 22 in FIG. 11 does not take place until the output temperature sensed by the bulb 34 reaches the 60° F as set by the auxiliary adjusting member 51 in the manner previously described.

In this manner, the control unit 20 cycles the heating unit "on" and "off" to control the same within the temperature settings of the knob 43 of the selector means 37 and the auxiliary adjusting member 51 thereof.

Therefore, it can be seen that the selector means 37 of the unit 20 of this invention is adapted to positively set the cut-out point or temperature for the heating means with the cut-in point or temperature being negative and being adjustable, i.e., the temperature setting of the control device 20 for cutting back in the actuator 22 is a temperature below the selected cut-out temperature and such temperature below the selected cut-out temperature is adjustable by adjusting the nut 53 relative to the auxiliary adjusting member 51 to operate in the manner previously described.

Figure 12:
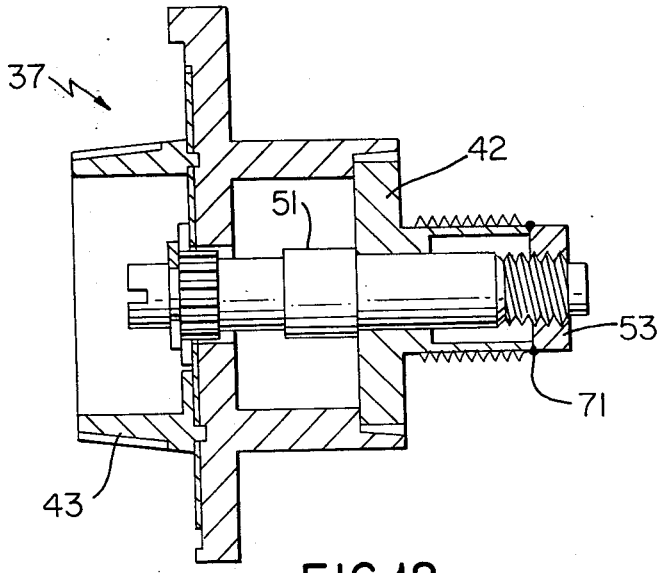
FIG. 12 is a view similar to FIG. 4 and illustrates another embodiment of the selector means of this invention.

Of course, such negative differential could be a fixed negative differential by merely eliminating the compression spring 55 and welding the nut 53 in its desired position in the slots 61 of the main adjusting member 42 by weld means 71 as illustrated in FIG. 12 whereby the selector means 37 illustrated in FIG. 12 has a fixed negative differential.

If it is desired to provide a positive differential for the control unit 20 with such positive differential being adjustable, another selector means of this invention can be utilized with the control unit 20 previously described and such selector means is generally indicated by the reference numeral 37A in FIGS. 13–18 and such selector means 37A will now be described with parts thereof similar to the parts of the selector means 37 being indicated by life reference numerals followed by the reference letter "A."

Figure 13:
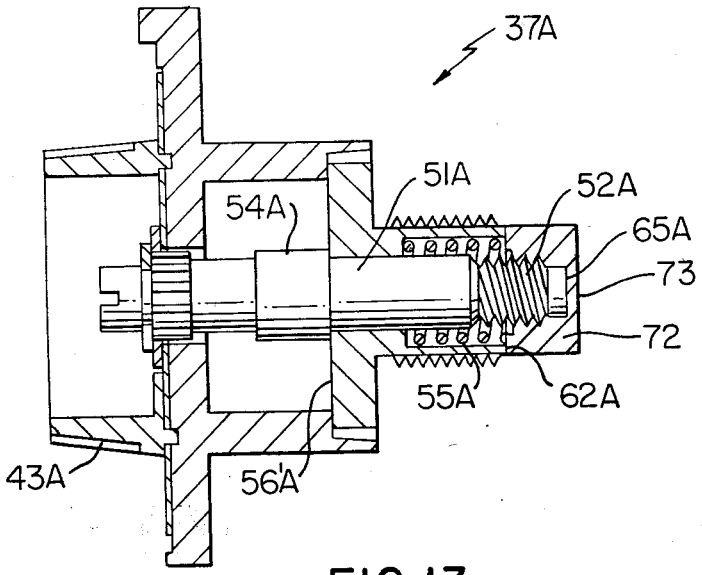
FIG. 13 is a view similar to FIG. 4 and illustrates still another embodiment of the selector means of this invention.

As illustrated in FIG. 13, the selector means 37A is substantially identical to the selector means 37 previously described except that a different shaped nut-like member 72 is disposed on the threaded end 52A of the auxiliary adjusting member 51A so that the same projects beyond the end surface 65A thereof to provide its own end surface 73 against which the bowed part 66A of the lever 30A is to operate in the manner illustrated in FIGS. 14–18 so that the lever 30A does not operate on the end 65A of the auxiliary adjusting member 51A whereby the unit 20 operates in a manner now to be described.

With the selector means 37A being substituted for the selector means 37 of the unit 20, the operator rotates the knob 43A of the selector means 37A to select the desired temperature for which the unit 20 is to have the heating means turned back on after the same has been turned off by the unit 20 and then adjusts the auxiliary adjusting member 51A to the desired number of degrees of temperature above the selected temperature that the unit 20 is to turn off the heating means. Thus, if the selector means 43A has been set to turn back on the heating means when the temperature drops to 70° F, the adjusting means 51A can be adjusted to a positive setting of 10° F so that the unit 20 will turn off the heating means when the temperature sensed by the bulb 34 reaches 80° F.

Figure 14:
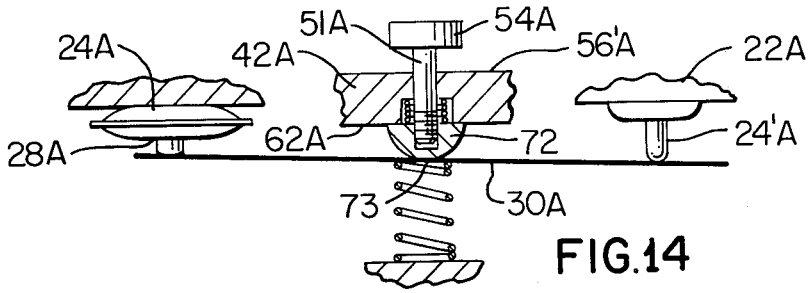
FIGS. 14–18 are views similar to FIGS. 7–11 and illustrate the control unit of FIG. 2 when utilizing the selector means of FIG. 13 for the purpose of illustrating the various stages of the operation thereof.
Figure 15:
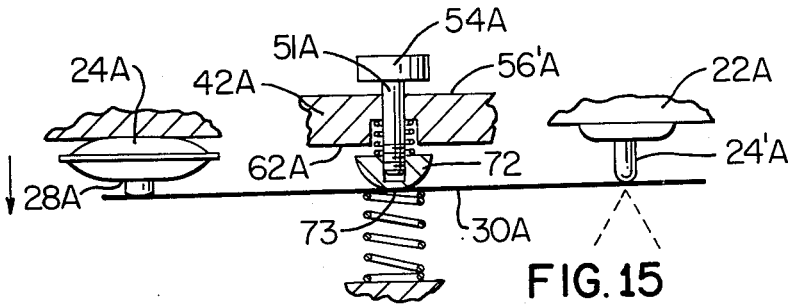

With the selector means 37A set in the manner previously described, it can be seen in FIGS. 14 and 15 that as the temperature being sensed by the bulb 34 increases from a point below the 80° F, the movable wall 28A of the condition responsive means 24A expands downwardly but because the enlarged head 54A of the adjusting member 51A is above the surface 56'A of the main adjusting member 42A, the lever 30A pivots on the plunger 24'A of the actuator 22A so that the same is not pushed inwardly until the enlarged head 54A hits against the furface 56'A of the main adjusting member 42A in the manner illustrated in FIG. 16. At this time, the lever 30 can pivot on the end 73 of the nut 72 to cause the plunger 24'A to move inwardly and open the switch construction 22 and, thus, terminate the operation of the heating means being controlled by the unit 20. Thus, it can be seen that such cut-out of the heating means by the expanding condition responsive means 24A is adjustable by the position of the nut 72 on the adjusting member 51A.

Figure 16:
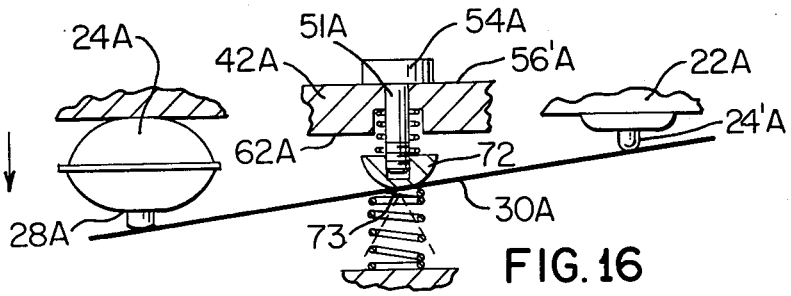
Figure 17:
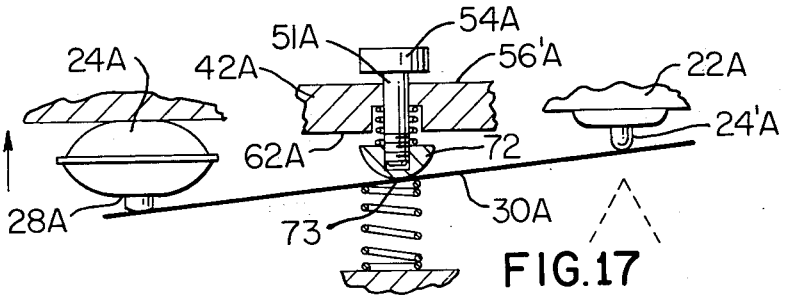
Figure 18:
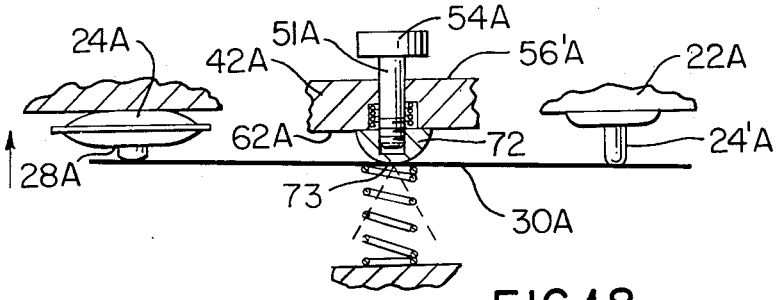

Thereafter, as the temperature being sensed by the bulb 34 decreases from the cut-out temperature of 80° F as illustrated in FIG. 16, the wall 28A of the condition responsive means 24A moves upwardly as illustrated in FIG. 17 and carries the adjusting member 51A therewith so that the lever 30A pivots on the actuator plunger 24'A until the nut 72 bottoms out against the surface 62A of the main adjusting member 42A as illustrated in FIG. 18 to permit the lever 30A to pivot on the nut 72 and thereby cause the plunger 24'A to again move outwardly as illustrated in FIG. 18 and cause the heating means to again operate, such position of the lever 30A taking place when the temperature is at the selected temperature of 70° F.

Thus, it can be seen that by utilizing the selector means 37A of FIG. 13 in the manner illustrated in FIGS. 14–18, the control unit 20 can have a desired temperature cut-in setting made by the knob 43A thereof with a positive differential or the cut-out temperature of such heating unit taking place either at that cut-in temperature or any desired differential therefrom in an increasing manner above the selected temperature up to approximately 45° F as illustrated for the control knob 43.

Therefore, it can be seen that this invention not only provides an improved control unit having an adjustable differential therefor, but also this invention provides an improved method of making such a control unit or the like.

While the forms and methods of this invention now preferred have been illustrated and described as required by the Patent Statute, it is to be understood that other forms and method steps can be utilized and still come within the scope of the appended claims.

What is claimed is:

1. In a method of making a control unit having a condition selector means, an actuator and a condition responsive device for actuating said actuator when said condition responsive device senses a condition selected by said selector means, the improvement comprising the steps of disposing a lever in said unit so as to be operatively associated with said actuator and said device whereby said device can actuate said actuator by said lever, forming said selector means with an adjustable part thereof that is engageable with said lever for providing a pivot point for said lever, forming said adjustable part to have an adjustable lost motion with said selector means, and adjusting said adjustable part to adjust said adjustable lost motion thereof and thus the differential in the operation of said actuator by said device.

2. In a method of making a control unit as set forth in claim 1, the further improvement wherein said step of adjusting said adjustable part adjusts said differential in a positive direction.

3. In a method of making a control unit as set forth in claim 1, the further improvement wherein said step of adjusting said adjustable part adjusts said differential in a negative direction.

4. In a method of making a control unit having a condition selector means, an actuator and a condition responsive device for actuating said actuator when said condition responsive device senses a condition selected by said selector means, the improvement comprising the steps of disposing a lever in said unit to have opposed ends respectively operatively associated with said actuator and said device, forming said selector means with an adjustable part thereof engageable with said lever intermediate said ends thereof for providing a pivot point for said lever, forming said adjustable part to have an adjustable lost motion with said selector means, and adjusting said adjustable part to adjust said adjustable lost motion thereof and thus the differential in the operation of said actuator by said device.

5. In a method of making a control unit as set forth in claim 4, the further improvement wherein said step of adjusting said adjustable part adjusts said differential in a positive direction.

6. In a method of making a control unit as set forth in claim 4, the further improvement wherein said step of adjusting said adjustable part adjusts said differential in a negative direction.

7. In a method of making a control unit as set forth in claim 4, the further improvement comprising the step of forming said selector means with means for adjusting said adjustable part for selecting said condition.

8. In a method of making a control unit as set forth in claim 7, the further improvement comprising the step of forming said means for adjusting said adjustable part from a rotatable member.

9. In a method of making a control unit as set forth in claim 8, the further improvement comprising the step of forming said adjustable part to be carried by said rotatable member and be rotatable relative thereto.

10. In a method of making a control unit as set forth in claim 9, the further improvement comprising the steps of forming said rotatable member to be axially moved relative to said lever upon rotatable movement thereof.

11. In a method of making a control unit as set forth in claim 10, the further improvement comprising the step of forming said adjustable part to be axially moved relative to said rotatable member and said lever upon rotational movement thereof.

12. In a method of making a control unit as set forth in claim 11, the further improvement comprising the step of forming said adjustable part to have said lost motion axially relative to said rotatable member.

13. In a method of making a control unit as set forth in claim 12, the further improvement comprising the step of forming said adjustable part so that when the same is adjusted relative to said rotatable member it adjusts said axial lost motion therebetween.

14. In a method of making a control unit as set forth in claim 13, the further improvement wherein said step of adjusting said axial lost motion adjusts said differential in a positive direction.

15. In a method of making a control unit as set forth in claim 13, the further improvement wherein said step of adjusting said axial lost motion adjusts said differential in a negative direction.

* * * * *